US005327916A

United States Patent [19]

Jones et al.

[11] Patent Number: 5,327,916

[45] Date of Patent: Jul. 12, 1994

[54] FILTER TIP CAGARETTE

[75] Inventors: David H. Jones, Leigh-on-Sea; Jerzy Kijowski, Billericay, both of England

[73] Assignee: Rothmans International Services Limited, United Kingdom

[21] Appl. No.: 945,942

[22] Filed: Sep. 17, 1992

[30] Foreign Application Priority Data

Oct. 23, 1991 [GB] United Kingdom ..... 9122448

[51] Int. Cl.[5] ..... A24D 1/04; A24D 3/00

[52] U.S. Cl. ..... 131/331; 131/336; 131/342; 131/361; 131/365

[58] Field of Search ..... 131/331, 342, 365, 336, 131/361

[56] References Cited

U.S. PATENT DOCUMENTS

| | | | |
|---|---|---|---|
| 3,640,285 | 2/1972 | Briskin | 131/365 |
| 3,744,496 | 7/1973 | McCarty | 131/342 |
| 4,481,960 | 11/1984 | Brooks | 131/336 |

*Primary Examiner*—William H. Grieb

*Attorney, Agent, or Firm*—Diller, Ramik & Wight

[57] ABSTRACT

A filter tip cigarette comprising a rod of smoking material having an inner wrapper of sidestream reducing paper containing carbon as part of its total filler content and an outer overwrapping cigarette paper, and a ventilated filter tip of low efficiency / high pressure drop which provides a mainstream CO / "tar" ratio of 1:0 or less in conjunction with the filter ventilation.

19 Claims, 1 Drawing Sheet

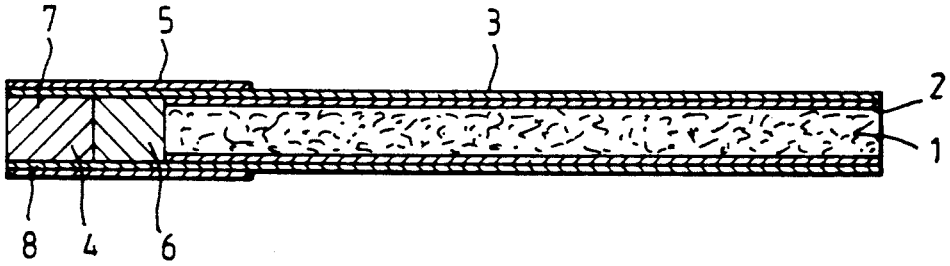
7
5
3
2
1
8
4
6

FILTER TIP CAGARETTE

This invention relates to a filter tip cigarette that gives reduced levels of sidestream smoke whilst maintaining acceptable mainstream smoke taste, puff number and tactile characteristics.

Cigarettes made with low sidestream papers reduce the quantity of particulate smoke given off to the sidestream but often produce greater quantities of carbon monoxide in the mainstream. At present, the only major way to reduce mainstream carbon monoxide is to use ventilation. Ventilating air can enter through naturally porous or specially perforated cigarette. papers or through ventilation zones in the filter tip. One of the problems associated with high levels of filter tip ventilation is a reduction in mainstream "tar" and cigarette pressure drop. Reducing mainstream carbon monoxide (CO) by ventilation will not significantly alter the ratio of CO to "tar" without making changes in the filter. However, reduction in the efficiency of the filter tip, when accompanied by a reduced filter pressure drop and high levels of tip ventilation lead to a product having an unacceptably low cigarette pressure drop.

To overcome this problem, it is proposed to use a low efficiency / high pressure drop filter in combination with low sidestream cigarette papers containing carbon as one of the active filler materials which have been overwrapped using conventional or other low sidestream papers as set forth in the Applicants' British Patent Application No. 9120060.0 (R.22).

According to the present invention therefore a filter tip cigarette comprises a rod of smoking material having an inner wrapper of sidestream reducing paper containing carbon as part of its total filler content and an outer overwrapping cigarette paper, and a ventilated filter tip of low efficiency / high pressure drop which provides a mainstream CO / "tar" ratio of 1.0 or less in conjunction with the filter ventilation.

The filter tip cigarette can be made in various ways and the accompanying drawing is a cross-sectional view through a cigarette incorporating the invention.

As shown in the drawing the cigarette comprises a rod of smoking material, for example tobacco, 1 which is located within an inner wrapper 2 made from a sidestream reducing paper containing carbon. This inner wrapper is enclosed with an overwrapping outer wrapper 3 made from a conventional cigarette paper or from a low sidestream cigarette paper. A filter element 4 is attached to the cigarette rod by a tipping paper 5.

To reduce the CO relative to "tar", a filter such as the Filtrona (UK) RATIO, LRV or TCT or the American Filtrona COD can be used. The RATIO filter is of dual or triple configuration and the dual version, which is shown in the drawings, consists of a low efficiency / high pressure drop segment 6 of polyethylene combined with a segment 7 made from cellulose acetate, polypropylene or paper in tow or web form, or other filtering material. The triple configuration could have, for example, granular carbon or a cavity between the polyethylene segment and the other filtering material. The pressure drop of the sections can be selected to provide the necessary pressure drop, filtration efficiency and degree of ventilation to meet a specified delivery target.

Typically, the filter could be made up as follows :

| PARAMETER | Section to tobacco rod | Section to mouth end |
|---|---|---|
| Length (mm) | 5–20 | 10–25 |
| Pressure drop (mmWG) | 50–200 | 10–25 |
| Material | polyethylene | cellulose acetate polypropylene paper |
| Circumference (mm) | 10–30 | 10–30 |
| Overall filter length (mm) | 15–40 | |

The filters are wrapped in a porous plugwrap 8 with a range of 1,000 to 50,000 CORESTA units.

To provide for filter tip ventilation the tipping paper 5 can be pre-perforated by mechanical, laser or electrostatic processes. Alternative tipping papers could include naturally porous papers or unperforated tipping papers. The latter would use on-line laser techniques to introduce ventilation holes to the filter. Typical filter tip ventilation levels are in the range of 10% –80%.

In an alternative construction the overwrapping outer wrapper 3 can be a conventional cigarette paper or some other low sidestream cigarette paper.

Each of the inner and outer papers can be of different porosity and unexpected results for the burn rates of cigarettes with this construction have been obtained. Use of a carbon-filled paper with a porosity of 12 CORESTA units gave a static burn rate of 4.6 mm/min but when overwrapped with a paper of porosity 120 CORESTA units, a burn rate of 5.8 mm/min was obtained. This resulted in a cigarette having two less puffs than the cigarette with just the carbon filled paper. In addition, the overwrapped cigarette gave rise to greater sidestream tar reduction (53%) relative to the cigarette with just the carbon-filled paper (29%) alone.

The range of cigarette design parameters which are suitable are :

RANGE OF CIGARETTE PARAMETERS

| PARAMETER | RANGE | PREFERRED VALUES |
|---|---|---|
| Cigarette length (mm) | 50–140 | 60–100 |
| Tobacco rod length (mm) | 40–100 | 50–90 |
| Filter length (mm) | 5–40 | 10–30 |
| Tobacco rod circumference (mm) | 10–30 | 17–25 |
| Tobacco rod density (mg/cc) | 120–300 | 180–275 |
| Inner paper porosity (CORESTA units) | 4–130 | 10–30 |
| Outer paper porosity (CORESTA units) | 4–300 | 20–300 |
| Filter tip ventilation (%) | 10–80 | 30–70 |
| Filter pressure drop (mmWG) | 10–250 | 50–150 |

In addition to the above cigarette specifications, it is possible to identify the key parameters for the inner wrapper:

PAPER SPECIFICATION

| PARAMETER INNER PAPER | RANGE | PREFERRED VALUES |
|---|---|---|
| Basis Weight $g/m^2$ | 20–60 | 35–50 |
| % Carbon in filler | 5–20 | 8–15 |
| % $Mg(OH)_2$ in filler | 5–20 | 6–11 |
| % $CaCO_3$ in filler | 5–20 | 15–20 |
| Porosity (CORESTA units) | 4–130 | 5–20 |

If desired the inner wrapper or the outer wrapper can be impregnated with or incorporate flavour components to improve the flavour of mainstream smoke and the aroma of sidestream smoke. This can be achieved by impregnating the carbon portion of the filler material in the inner paper or by incorporating a flavour component in the filler materials of either paper.

Additionally, irritant reducing and impact enhancing compounds can be added to the filler used in the paper.

Carbon used in the filler can have a range of surface areas and activities. Typically the surface area of the carbon used will be in the range 200 to 2000 $m^2g^{-1}$ with activities (measured by the Carbon Tetrachloride method of absorption) in the range of 20% to 150%.

We claim:

1. A filter tip cigarette comprising a rod of smoking material having an inner wrapper of sidestream reducing paper containing carbon as part of its total filler content and an outer overwrapping cigarette paper, and a ventilated filter tip of low efficiency having a high pressure drop of more than 60 mmWG which provides a mainstream CO/"tar" ratio of 1.0 or less in conjunction with the filter ventilation.

2. A filter tip cigarette as claimed in claim 1 in which the outer wrapper is a conventional cigarette paper or a low sidestream cigarette paper.

3. A filter tip cigarette as claimed in claim 2 in which the inner wrapper and outer wrapping are of different porosity.

4. A filter tip cigarette as claimed in claim 1 in which the outer overwrapping is impregnated with or incorporates a flavour component.

5. A filter tip cigarette as claimed in claim 1 in which the carbon portion of the filler is impregnated with a flavour component.

6. A filter tip cigarette as claimed in claim 1 in which the filler material incorporates a flavour component.

7. A filter tip cigarette as claimed in claim 1 in which an irritant reducing compound is added to the filler.

8. A filter tip cigarette as claimed in claim 1 in which an impact enhancing compound is added to the filler.

9. A filter tip cigarette as claimed in claim 1 in which the surface area of the carbon used in the filler is in the range of 200 to 2000 $m^2g^{-1}$ with activities (measured by the Carbon Tetrachloride method of absorption) in the range of 20% to 150%.

10. A filter tip cigarette as claimed in claim 1 in which the filter is of multiple construction including two or more segments.

11. A filter tip cigarette as claimed in claim 10 in which one segment is of low efficiency / high pressure drop.

12. A filter tip cigarette as claimed in claim 11 in which the low efficiency / high pressure drop segment is made from polyethylene.

13. A filter tip cigarette as claimed in claim 11 in which one segment is made from cellulose acetate, polypropylene, paper, or other filtering material.

14. A filter tip cigarette as claimed in claim 1 in which said filter is enclosed by a porous plug wrap with a range of 1,000 to 50,000 CORESTA units.

15. A filter tip cigarette as claimed in claim 1 in which said filter is attached to the cigarette rod by a porous or ventilated tipping paper.

16. A filter tip cigarette as claimed in claim 15 in which the tipping paper has been perforated by mechanical, laser or electrostatic processes.

17. A filter tip cigarette as claimed in claim 1 in which the filter tip ventilation level is in the range of 10%-80%.

18. A filter tip cigarette as claimed in claim 12 in which one segment is made from cellulose acetate, polypropylene, paper, or other filtering material.

19. The filter tip cigarette as claimed in claim 1 wherein the ventilated filter tip has a high pressure drop range of between 60 mmWG and 200 mm WG.

* * * * *

UNITED STATES PATENT AND TRADEMARK OFFICE

CERTIFICATE OF CORRECTION

PATENT NO. : 5,327,916

DATED : July 12, 1994

INVENTOR(S) : david H. Jones, et. al.

It is certified that error appears in the above-indentified patent and that said Letters Patent is hereby corrected as shown below:

Title page, item [54] and col. 1, line 1, title should read--FILTER TIP CIGARETTE --.

Signed and Sealed this

Third Day of January, 1995

Bruce Lehman

*Attest:*

BRUCE LEHMAN

*Attesting Officer*

*Commissioner of Patents and Trademarks*